United States Patent [19]

Sherlock et al.

[11] Patent Number: 4,562,984

[45] Date of Patent: Jan. 7, 1986

[54] DRAINAGE BAG SUPPORT

[75] Inventors: Paul Sherlock, San Francisco, Calif.; Benjamin Brausen, Cromwell, Conn.; Phillip P. Klein, Dallas, Tex.

[73] Assignee: Sherwood Medical Company, St. Louis, Mo.

[21] Appl. No.: 520,954

[22] Filed: Aug. 8, 1983

[51] Int. Cl.[4] ..... B65B 67/12

[52] U.S. Cl. ..... 248/95; 128/DIG. 24; 248/328; 604/322

[58] Field of Search ..... 248/95, 214, 215, 320, 248/328; 16/319, 325, 334; 128/DIG. 24; 604/408, 322, 323, 324, 325, 326

[56] References Cited

U.S. PATENT DOCUMENTS

| | | | |
|---|---|---|---|
| 2,966,697 | 1/1961 | Mintz | 16/325 X |
| 3,254,817 | 6/1966 | Bartz | 248/95 X |
| 3,371,897 | 3/1968 | Serany, Jr. et al. | 248/95 X |
| 3,534,738 | 10/1970 | Huck | 248/95 X |
| 3,537,109 | 11/1970 | Spurrier et al. | 248/95 X |
| 3,776,231 | 12/1973 | Holbrook et al. | 248/95 X |
| 3,924,781 | 12/1975 | Witte | 248/95 X |
| 4,178,934 | 12/1979 | Forman | 128/295 |
| 4,194,715 | 3/1980 | Forman et al. | 248/311.1 R |
| 4,219,177 | 8/1980 | O'Day | 248/95 X |
| 4,312,352 | 1/1982 | Meisch et al. | 128/294 |
| 4,317,550 | 3/1982 | Hannah | 248/95 |
| 4,332,252 | 6/1982 | Taylor | 248/95 X |
| 4,460,366 | 7/1984 | Shinno | 604/408 |

*Primary Examiner*—J. Franklin Foss
*Assistant Examiner*—David L. Talbott
*Attorney, Agent, or Firm*—Stanley N. Garber; William R. O'Meara

[57] ABSTRACT

A support for suspending a body fluid drainage bag from a structure includes a generally planar one-piece body having first and second opposed ends including a hanger at the first end to which a drainage bag can be attached. A support arm depends from the second end and is connected via a living hinge to the body, the body, the living hinge and the support arm being of one piece. The support arm is movable from a first position in the plane of the body to a second position perpendicular thereto. The support arm and body include cooperating locking members to lock the support arm in the second position while at the same time removing the load from the living hinge. The support arm is configured to accomodate two different sizes of standard hospital bed frames and auxiliary string support attachments are provided to allow the drainage bag to be supported a continuously variable distance below the structure from which it is suspended.

29 Claims, 11 Drawing Figures

FIG. 1
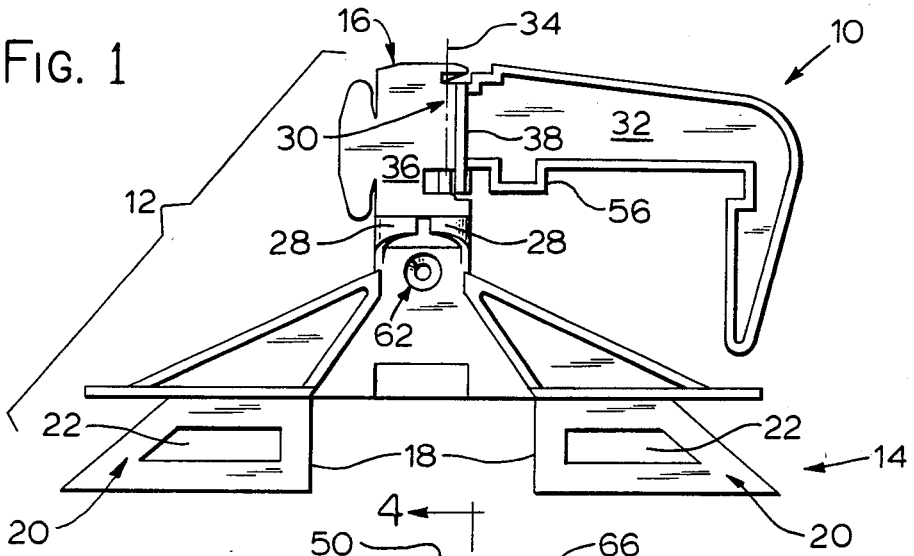
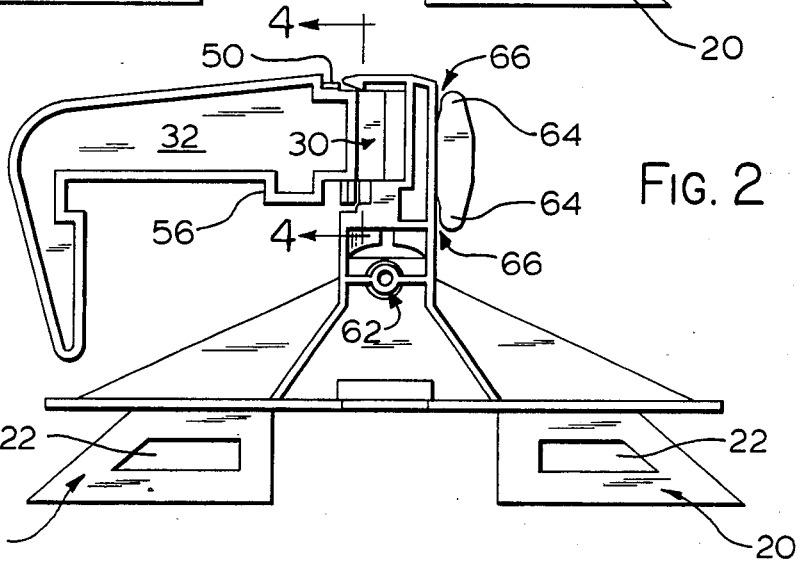
FIG. 2
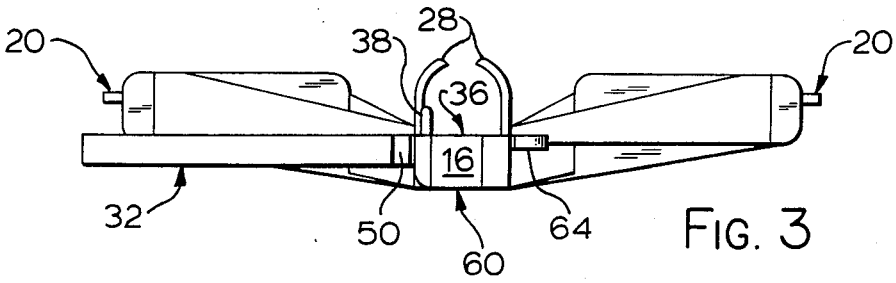
FIG. 3

DRAINAGE BAG SUPPORT

BACKGROUND OF THE INVENTION

This invention relates to body fluid drainage apparatus, and in particular to a support for suspending a body fluid drainage bag from a structure such as a hospital bed frame.

Flexible collection containers or bags fabricated from plastic films are used in various applications such as the collection of body fluids from hospital patients. These containers, however, are not sufficiently rigid to support themselves in an upright position during collection of body fluids. Moreover, such containers may not be laid flat during collection because of the potential of leakage back through the fluid inlet port, with attendant hazard to the patient. Some bags also provide an accurate volume reading of the fluid collected, but to do so it is necessary that the bag be supported substantially vertically.

For example, during urinary catheterization a patient is connected to a urinary drainage bag formed of flexible plastic film with volume indicia inscribed on an outer face of the bag. In this procedure a continuous indication of the amount of urine expelled from the body is desired, which can be obtained only if the bag is supported vertically.

In instances where the patient is confined to bed, it is desirable to have a hook or some other means for attaching the bag to the bed of the patient. There are, however, at least two different sizes of bed frames, namely 1 ¼ inch and 1 ½ inch, both of which use angle iron. To maintain the collection bag vertical, it is important that the hook or other attaching device closely fit either size bed frame. In other instances it is desirable to hang the bag from odd-sized frames or at different heights below the level of the patient. Present drainage bag supports do provide a loop of string for this purpose, but such a loop uses more string than is necessary and does not provide for easy variability of the height of the bag.

Various supports for drainage bags have been proposed to address several of the above problems but they can be improved in certain respects or for certain applications. For example, co-assigned U.S. Pat. No. 4,194,715 to Forman et al. discloses a two-piece drainage bag support. It would, however, be desirable to obtain the functions of the Forman et al. support in a one-piece support since the two-piece construction requires extra molding and assembly. Similarly, U.S. Pat. No. 4,312,352 to Meisch et al. shows a one-piece hanger, hook and handle assembly for a urinary drainage bag, which assembly uses a pair of living hinges to permit the hooks and hanger to be molded from one piece. However, in this construction, the load of the drainage bag is applied to the living hinge, which is the thinnest part of the assembly.

SUMMARY OF THE INVENTION

Among the several objects and features of the present invention may be noted the provision of a drainage bag support which supports a drainage bag substantially vertically from a wide variety of bed frames and other structures; the provision of such a support with a hook which tightly fits two standard sizes of bed frames; the provision of such a support which provides for simple, continuously adjustable height of the drainage bag below the level of the patient; the provision of such a support which is of relatively inexpensive one-piece construction; the provision of such a support which uses living hinges but removes the load from them; and the provision of such a support which is relatively simple and inexpensive to manufacture.

Briefly the drainage bag support of the present invention includes a generally planar one-piece body having first and second opposed ends. The body includes a hanger at the first end to which a drainage bag can be attached. A support arm depends from the second end of the body, the arm being connected via a living hinge to the body. The body, living hinge and support arm are of one piece. The support arm is movable from a first position substantially in the plane of the body to a second position substantially perpendicular to the plane of the body. Locking lugs and surfaces integral with the body and the support arm are provided for locking the support arm in position with respect to the body. The locking lugs and surfaces define an axis extending therethrough from the second end of the body generally toward the first end of the body. The living hinge has an axis about which the support arm is rotatable from its first to its second position. The living hinge axis is generally parallel to but spaced from the axis of the locking lugs and surfaces.

In a second aspect, the support of the present invention includes a generally planar body connected to a support arm at a first end and having a hanger to which a drainage bag can be attached at a second end. The body has a generally flat rear surface. The support arm is generally L-shaped and is movable to a position generally perpendicular to the plane of the body in which the spine of the L-shaped support arm extends generally perpendicularly from the flat rear surface of the body and the base of the L-shaped support extends downwardly generally parallel to the flat rear surface. The distance between the flat rear surface of the body and the base of the support arm is a first predetermined distance selected to closely fit a first predetermined size of structure. The spine of the support arm has a lug adjacent to and extending downwardly toward the flat rear surface of the body and the base of the support arm has a notch therein at the intersection of the base and the spine of the support arm. The distance between the lug and the interior surface of the notch is a second predetermined distance selected to closely fit a second predetermined size of structure, the second size being smaller than the first size, whereby a drainage bag suspended from the support is suspended vertically when the support is used with either the first or the second sized structure.

In a third aspect of this invention, the support includes a generally planar one-piece body having a support arm at a first end and a hanger to which a drainage bag can be attached at a second end. The support arm is connected via a living hinge to the body. The body, living hinge and support arm are of one piece. The support arm is movable from a first position substantially in the plane of the body to a second position substantially perpendicular to the plane of the body. Structure integral with the body and the support arm is provided for locking the support arm in the second position with respect to the body and for supporting the weight of the drainage bag when the support arm is in the second position without causing that weight to be applied to the living hinge.

In a fourth aspect, the support of the present invention includes a generally planar body having a hanger to which a drainage bag can be attached at one end. A passage extends through the body which is of sufficient size to permit a cord to pass therethrough for use in attaching the support to the structure. The passage is generally of the shape of a truncated cone, the sizes of the openings of the cone being selected so that a knot in the cord may enter the larger opening of the passage but may not pass through the smaller opening, whereby the knot is retained in the cone-shaped passage when force is applied to pull the knot toward the smaller opening of the passage. Ears integral with the body are provided for frictionally engaging the cord to hold it in place at continuously variable positions along the cord, whereby a drainage bag can be suspended at variable distances from the structure by tying a knot in one end of a cord, passing a desired length of the cord starting with the other end of the cord through the small opening of the passage, over a portion of the structure and back down to the frictional engaging means.

Other objects and features will be in part apparent and in part pointed out hereinafter.

BRIEF DESCRIPTION OF THE DRAWINGS

FIG. 1 is a front elevation of the support of the present invention;

FIG 2 is a rear elevation of the support shown in FIG. 1;

FIG. 3 is a plan view of the support shown in FIG. 1;

Similar reference characters indicate similar parts throughout the several views of the drawings.

DESCRIPTION OF THE PREFERRED EMBODIMENT

Figure 11:
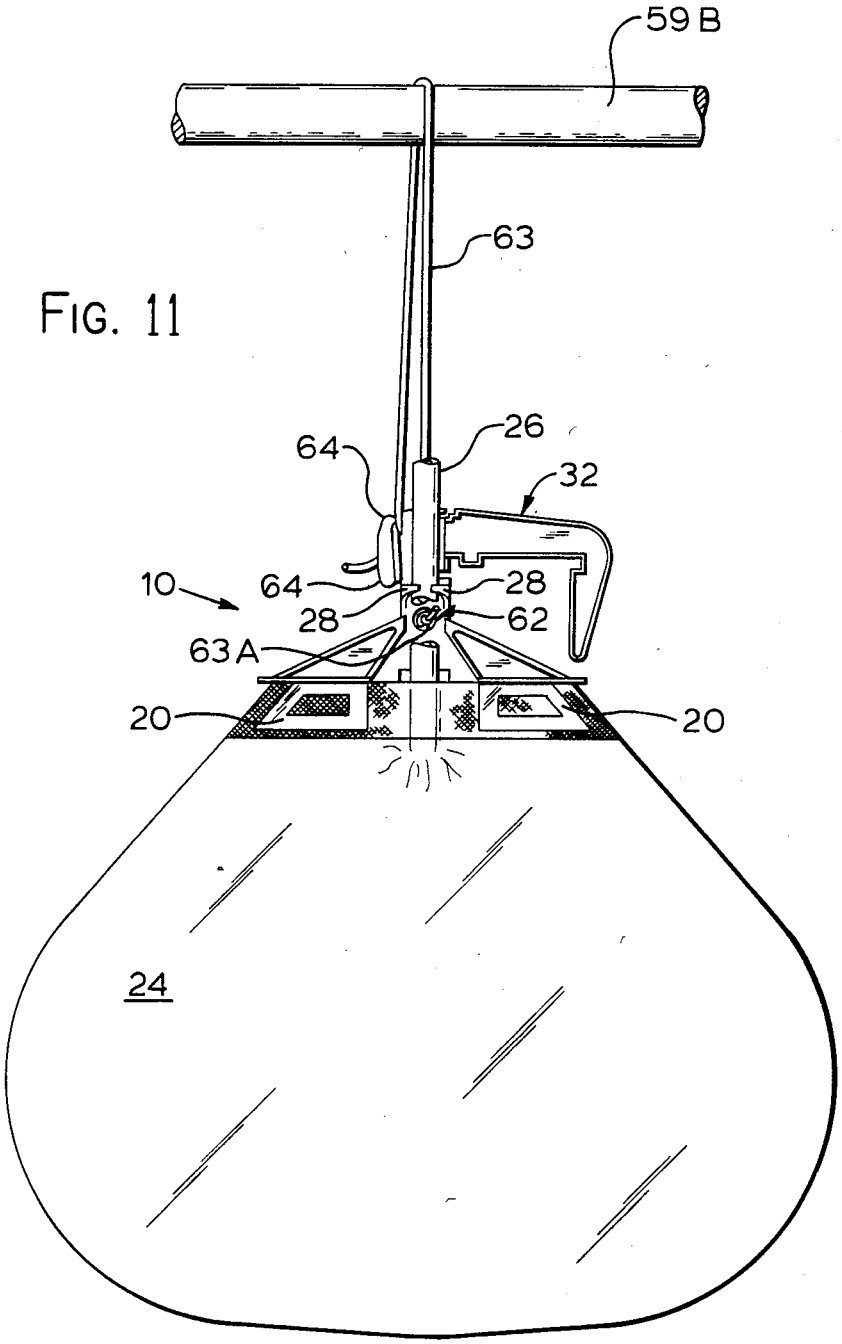
FIG. 11 is a front elevation on a reduced scale and with parts broken away showing the support of FIG. 1 attached to a drainage bag and illustrating an alternative means of support.

Turning now to the drawings, there is shown in FIG. 1 a drainage bag support 10 of the present invention. The body of support 10, indicated generally at 12 is generally planar and is preferably molded out of a single piece of suitably rigid plastic. Body 12 has first and second ends 14 and 16 respectively which in use are the bottom and top of the support. A hanger 18 comprising a pair of trapezoidally-shaped tabs 20 each having a trapezoidally-shaped window 22 therein is included at the bottom of body 12. A drainage bag 24 (see FIG. 11) can be attached to tabs 20 of hanger 18 by any suitable means such as radio frequency sealing. Tabs 20 are disposed toward the front surface of body 12 and are widely spaced to permit the use of support 10 with a wide variety of tubes and inlets. One such tube 26 is shown in FIG. 11 extending down through a pair of tube-holding curved arms 28 from a patient (not shown) to the inlet of bag 24.

Figure 10:
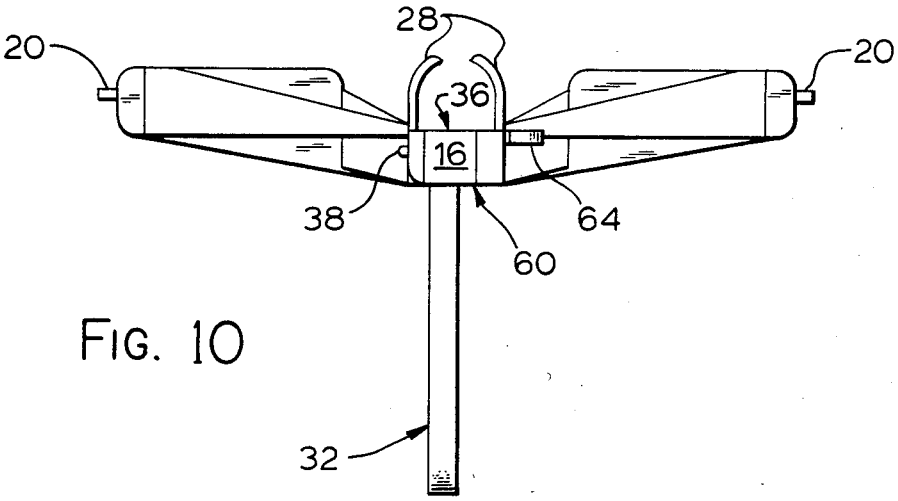
FIG. 10 is a plan view similar to FIG. 3 but with the hook portion of the support rotated to the position shown in FIG. 9.

Above arms 28, which are also molded in one-piece with body 12, there is a living hinge 30 connecting the top end of body 12 to a ribbed hook or support arm 32. Body 12, living hinge 30, and support arm 32 are of molded, one-piece construction which permits relative inexpensive and dependable manufacture of support 10. Support arm 32 is movable or rotatable about the axis 34 of living hinge 30 from a first position (FIG. 3) substantially in the plane of body 12 to a second position (FIG. 10) substantially perpendicular to the plane of the body.

Figure 5:
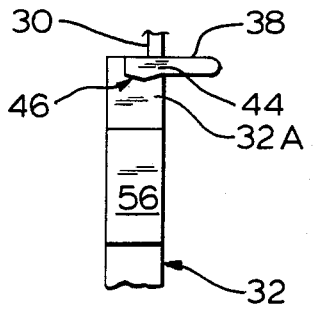
FIG. 5 is a section, with parts broken away, taken along line 5—5 of FIG. 4.
Figure 8:
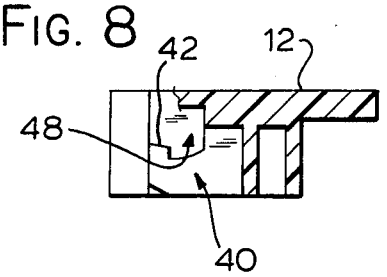
FIG. 8 is a section, with parts broken away, taken along line 8—8 of FIG. 6.

In its first position with respect to body 12, the front of support arm 32 is generally co-planar with the front surface 36 of body 12 and with the living hinge. Support arm 32 includes a tab or abutment surface 38 generally perpendicular to the front of support arm 32 and adjacent living hinge 30. When the support arm is rotated to the second position with respect to the body 12 (see FIG. 9), the lower part of abutment surface 38 abuts a raised portion 40 of body 12. More particularly it abuts the inclined front surface 42 (see FIG. 8) of raised portion 40 to prevent rotation of the support arm past the second position. At its rear as seen in FIG. 5, tab 38 is enlarged to form a cam 44 which includes an inclined surface 46. Inclined surface 46 of cam 44 cooperates with inclined front surface 42 of raised portion 40 to tend to force the bottom 32A of support arm 32 frontwardly as the support arm is rotated from its first to its second position. As the second position is reached, cam 44 falls or is snapped into a notch 48 in raised portion 40. Notch 48 is configured to receive cam 44 in a relatively tight fit to prevent undue wobble of support arm 32 with respect to body 12. The camming action as the arm is moved to the second position causes the arm to snap into place when the encounter with notch 48 causes the camming force to be removed.

Figure 4:
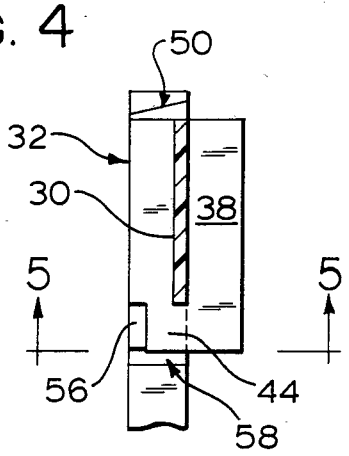
FIG. 4 is a section, on an enlarged scale and with parts broken away, taken along line 4—4 of FIG. 2.
Figure 6:
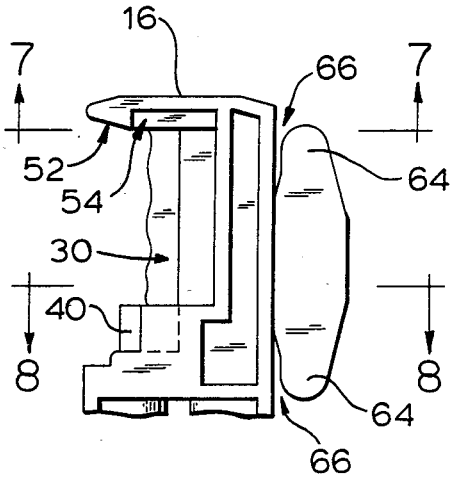
FIG. 6 is an enlarged view of a portion of FIG. 2, with parts broken away, of the locking and supporting structure of the support of the present invention.
Figure 7:
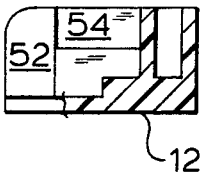
FIG. 7 is a section, with parts broken away, taken along line 7—7 of FIG. 6.

A similar camming action, but at right angles to that just described, occurs at the top of body 12 as support arm 32 is rotated to the second position. Arm 32 includes an inclined, camming surface 50 (FIGS. 2–4) at the top of support arm 32 adjacent tab 38 and the living hinge, which surface proceeds downwardly from front to rear of the support arm. A cooperating inclined camming surface 52 (FIGS. 6 and 7) on body 12 is disposed generally above the living hinge and extends transversely of the living hinge toward support arm 32. Surface 52 inclines downwardly from the side adjacent the support arm in FIG. 6 and terminates at the side away from the support arm in an upwardly extending notch 54 in which camming surface 50 of the support arm seats when the support arm is in its second position. As support arm 32 rotates from its first to its second position, surface 50 cams surface 52 and the adjacent part of body 12 upwardly until surface 50 clears surface 52 and snaps into notch 54, thereby locking the support arm in its second position. From the above it can be seen that surfaces 50 and 52, along with cam 44, raised portion 40 and notches 48 and 54 constitutes means for locking the support arm in the second position with respect to body 12. They also define a load bearing axis 55 which is generally parallel to but spaced from the axis of the living hinge (see FIG. 9). In the second position the locking means transfers the load of the drainage bag and its contents to the support arm, thus removing the load from the living hinge.

Figure 9:
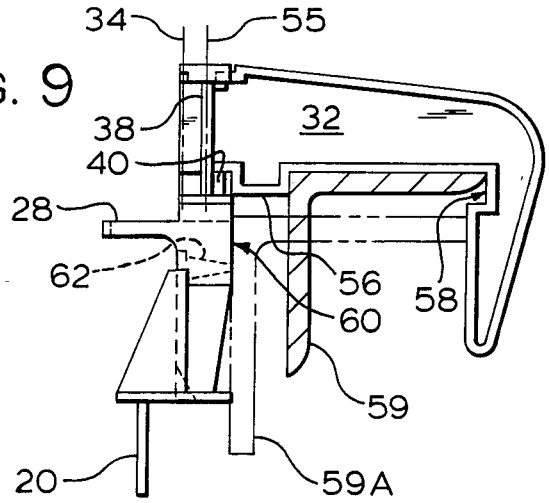
FIG. 9 is a right side elevation showing the support of the present invention suspended from bed frames of two different sizes.

Support arm 32 is generally L-shaped, the spine of the L having a downwardly extending tab or lug 56 which abuts raised portion 40 of body 12 in FIG. 9 and which terminates a short distance from portion 40. Tab 56 has a function of bearing compressive loads and also serves, in cooperation with a notch 58 at the intersection of the spine and base of the support arm to provide a close fit to a standard 1 ¼ inch angle-iron hospital bed frame 59. The back of the 1 ¼ inch angle-iron rests against tab 56 while the end of the arm of the angle-iron fits securely in notch 58, all as shown in FIG. 9. Similarly, hook 32 can accomodate the larger 1 ½ inch size bed frame 59A (shown in phantom) beneath tab 56 and notch 58. More particularly, the back of the larger angle-iron rests below tab 56 (in FIG. 9 it is shown spaced therefrom for clarity) against a flat rear surface 60 of body 12 while the end of the arm of the 1 ½ inch angle-iron is securely pressed against the base of hook 32 below notch 58 (see FIG. 9).

In some situations it will not be possible or desirable to use hook 32 as described above to attach the support 10 to a structure such as a hospital bed frame. For these situations, support 10 includes a truncated cone-shaped passage 62 (FIGS. 1, 2, 9 and 11) extending through body 12 from front to rear thereof with the larger opening of the passage at the front of body 12 and the smaller opening at the rear thereof. The sizes of these openings are selected so that a string 63 may be passed through both openings and a knot 63A tied in the string may pass through the larger opening but not the smaller. The passage is preferably deep enough so that the knot may be pulled into passage 62 to be completely out of the way of the drainage tube 26 (see FIG. 11). The string secured in passage 62 by the knot therein may then be looped around or otherwise secured to the structure from which the bag is to be suspended. Or, as shown in FIG. 11, it may be looped over the structure 59B and the free end pulled into frictional engagement with one or both of a pair of integrally molded ears 64 adjacent the top of body 12 which constitutes means for frictionally engaging the free end of the string to hold it in place. The distance between support 10 and the structure from which it is suspended is continuously variable with this arrangement because the ears will hold the string at whatever position along the string is desired. More particularly, the string is slid, at the desired position along its length, into one or both of a pair of slits 66 defined by ears 64 and body 12, which slits are open at one end and of generally decreasing width toward the other end, until the string is frictionally held in position in the slit.

In view of the foregoing, it will be seen that the various objects and features of the present invention are attained.

As various changes could be made in the above construction without departing from the scope of the invention, it is intended that all matter contained in the above description or shown in the accompanying drawings shall be interpreted as illustrative and not in a limiting sense.

What is claimed is:

1. A support for suspending a body fluid drainage bag from a structure comprising:

a generally planar one-piece body having first and second opposed ends, said body including a hanger at said first end to which a drainage bag can be attached;

a support arm depending from the second end of the body, said support arm being connected via a living hinge to the body, said body, living hinger and support arm being of one piece;

said support arm being movable from a first position substantially in the plane of the body to a second position substantially perpendicular to the plane of the body; and locking means integral with the body and the support arm for locking the support arm in the second position with respect to the body, said locking means when the support arm is locked in the second position having an axis extending therethrough from the second end of the body generally toward the first end of the body, said locking means including first cooperating members disposed on the support arm and second cooperating members disposed on the body, which first and second cooperating members are physically spaced in the first position;

said living hinge having an axis about which the support arm is rotatable from its first to its second position, said living hinge axis being generally parallel to but spaced from the axis of the locking means.

2. The support as set forth in claim 1 wherein the hanger includes a pair of tabs disposed at opposite ends of the hanger, each tab having a window therein to promote sealing of a drainage bag to the tabs.

3. The support as set forth in claim 1 wherein the body and support arm have surfaces which are substantially co-planar with one surface of the living hinge when the support arm is in its first position with respect to the body, further including a planar abutment surface on the support arm which extends perpendicularly from the plane of the body and support arm when the support arm is in its first position with respect to the body, said abutment surface being movable with the support arm to the second position with respect to the body in which position the abutment surface abuts a portion of the locking means of the body to prevent relative movement of the support arm past the second position.

4. The support as set forth in claim 1 wherein the first and second cooperating members of the locking means includes a pair of cooperating inclined surfaces on the support arm and body which deflect a portion of the second end of the body in a first direction with respect to the support arm as the support arm is moved from the first to the second position, said inclined surface on the body terminating in a notch in which the inclined surface of the support arm is held when the support arm is in the second position.

5. The support as set forth in claim 4 wherein the first and second cooperating members of the locking means further includes a second pair of cooperating inclined surfaces on the support arm and body which tend to deflect a portion of the support arm with respect to the body in a second direction perpendicular to the first direction as the support arm is moved from the first to the second position, said second inclined surface on the body terminating in a second notch in which the second inclined surface of the support arm is held when the support arm is in the second position.

6. The support as set forth in claim 5 wherein the first and second inclined surfaces of the support arm and the corresponding first and second notches of the body define the axis of the locking means when the support arm is in the second position.

7. A support for suspending a body fluid drainage bag from a structure comprising:

a generally planar body connected to a support arm at a first end and having a hanger to which a drainage bag can be attached at a second end, said body having a generally flat rear surface, said support arm being generally L-shaped and being movable to a position generally perpendicular to the plane of the body in which the spine of the L-shaped support arm extends generally perpendicularly from the flat rear surface of the body and the base of the L-shaped support arm extends downwardly generally parallel to said flat rear surface, the distance between the flat rear surface of the body and the base of the support arm being a first predetermined distance selected to closely fit a first predetermined size of structure;

the spine of the support arm having a lug adjacent to and extending downwardly toward the flat rear surface of the body and said base of the support arm having a notch therein at the intersection of the base and the spine of the support arm, the distance between the lug and the interior surface of the notch being a second predetermined distance selected to closely fit a second predetermined size of structure, said second size being smaller than said first size, whereby a drainage bag suspended from the support is suspended vertically when the support is used with either the first or the second sized structure.

8. The support as set forth in claim 7 wherein the hanger includes a pair of tabs disposed at opposite ends of the hanger, each tab having a window therein to promote sealing of a drainage bag through the tabs.

9. The support as set forth in claim 8 wherein a drainage bag is attached to the tabs by means of radio frequency sealing.

10. The support as set forth in claim 8 wherein the tabs are trapezoidal in shape.

11. The support as set forth in claim 10 wherein the two non-parallel sides of each trapezoidally-shaped tab are of unequal lengths, the longer of said sides extending downwardly and away from the center of the body.

12. The support as set forth in claim 10 wherein the windows in the tabs are also trapezoidal in shape.

13. The support as set forth in claim 8 wherein the tabs are disposed substantially adjacent the side of the body which is opposite the support arm when the arm is in the second position with respect to the body.

14. The support as set forth in claim 7 wherein the support arm is movable from a first position with respect to the body in which the body and support arm have surfaces which are substantially co-planar with one surface of the living hinge to a second position in which the support arm is generally perpendicular to the plane of the body.

15. The support as set forth in claim 14 further including a planar abutment surface on the support arm which extends perpendicularly from the plane of the body and support arm when the support arm is in its first position with respect to the body.

16. The support as set forth in claim 15 wherein the abutment surface is movable with the support arm to the second position with respect to the body in which position the abutment surface abuts a portion of the locking means of the body to prevent relative movement of the support arm past the second position.

17. The support as set forth in claim 14 wherein the locking means includes a pair of cooperating inclined surfaces on the support arm and body which deflect a portion of the first end of the body in a first direction with respect to the support arm as the support arm is moved from the first to the second position, said inclined surface on the body terminating in a notch in which the inclined surface of the support arm is held when the support arm is in the second position.

18. The support as set forth in claim 17 wherein the locking means further includes a second pair of cooperating inclined surfaces on the support arm and body which tend to deflect a portion of the support arm with respect to the body in a second direction perpendicular to the first direction as the support arm is moved from the first to the second position, said second inclined surface on the body terminating in a second notch in which the second inclined surface of the support arm is held when the support arm is in the second position.

19. A support for suspending a body fluid drainage bag from a structure comprising:

a generally planar one-piece body having a support arm at a first end and a hanger to which a drainage bag can be attached at a second end, said support arm being connected via a living hinger to the body, said body, living hinge and support arm being of one piece, said support arm being movable from a first position substantially in the plane of the body to a second position substantially perpendicular to the plane of the body; and means integral with the body and the support arm for locking the support arm in the second position with respect to the body and for supporting the weight of the drainage bag when the support arm is in the second position without causing that weight to be applied to the living hinge, said locking means including first cooperating members disposed on the support arm and second cooperating members disposed on the body which first and second cooperating members are physically spaced apart when the support arm is in the first position.

20. The support as set forth in claim 19 wherein the hanger includes a pair of tabs disposed at opposite ends of the hanger, each tab having a window therein to promote sealing of a drainage bag to the tabs.

21. The support as set forth in claim 19 wherein the locking means includes a pair of cooperating inclined surfaces on the support arm and body which deflect a portion of the first end of the body in a first direction with respect to the support arm as the support arm is moved from the first to the second position, said inclined surface on the body terminating in a notch in which the inclined surface of the support arm is held when the support arm is in the second position.

22. The support as set forth in claim 21 wherein the locking means further includes a second pair of cooperating inclined surfaces on the support arm and body which tend to deflect a portion of the support arm with respect to the body in a second direction perpendicular to the first direction as the support arm is moved from the first to the second position, said second inclined surface on the body terminating in a second notch in which the second inclined surface of the support arm is held when the support arm is in the second position.

23. The support as set forth in claim 22 wherein the first and second inclined surfaces of the support arm and the corresponding first and second notches of the body define the axis of the locking means when the support arm is in the second position.

24. A support for suspending a body fluid drainage bag from a structure comprising:

a generally planar body having a hanger to which a drainage bag can be attached at one end;

a passage extending through the body of sufficient size to permit a cord to pass therethrough for use in attaching the support to the structure, said passage being generally of the shape of a truncated cone, the sizes of the openings of said cone being selected so that a knot in the cord may enter the larger opening of the passage but may not pass through the smaller opening, whereby the knot is retained in the cone-shaped passage when force is applied to pull the knot toward the smaller opening of the passage; and means integral with the body for frictionally engaging the cord to hold it in place at continuously variable positions along the cord, whereby a drainage bag can be suspended at variable distances from the structure by tying a knot in one end of a cord, passing a desired length of the cord starting with the other end of the cord through the small opening of the passage, over a portion of the structure and back down to the frictional engaging means.

25. A support as set forth in claim 24 wherein the frictional engaging means includes at least one ear extending from the body and defining, between the ear and the body, a slit open at one end and of generally decreasing width toward the other end.

26. The support as set forth in claim 24 wherein the hanger includes a pair of tabs disposed at opposite ends of the hanger, each tab having a window therein to promote sealing of a drainage bag through the tabs.

27. The support as set forth in claim 26 wherein the tabs are trapezoidal in shape.

28. The support as set forth in claim 27 wherein the two non-parallel sides of each trapezoidally-shaped tab are of unequal lengths, the longer of said sides extending downwardly and away from the center of the body.

29. The support as set forth in claim 27 wherein the windows in the tabs are also trapezoidal in shape.

* * * * *